US010829274B2

(12) United States Patent
Pristera et al.

(10) Patent No.: US 10,829,274 B2
(45) Date of Patent: Nov. 10, 2020

(54) FLIP-TOP CLOSURE

(71) Applicant: CLOSURE SYSTEMS INTERNATIONAL INC., Memphis, TN (US)

(72) Inventors: Jeff Pristera, Brownsburg, IN (US); Ryan Konger, Brownsburg, IN (US); Leland Troy Lutton, Crawfordsville, IN (US)

(73) Assignee: Closure Systems International Inc., Memphis, TN (US)

( * ) Notice: Subject to any disclaimer, the term of this patent is extended or adjusted under 35 U.S.C. 154(b) by 0 days.

(21) Appl. No.: 16/192,079

(22) Filed: Nov. 15, 2018

(65) Prior Publication Data

US 2020/0156829 A1 May 21, 2020

(51) Int. Cl.

| | |
|---|---|
| ***B65D 47/08*** | (2006.01) |
| *B65D 41/04* | (2006.01) |
| *B65D 41/34* | (2006.01) |

(52) U.S. Cl.

CPC ..... *B65D 47/0842* (2013.01); *B65D 41/0428* (2013.01); *B65D 41/3423* (2013.01); *B65D 2401/25* (2020.05); *B65D 2401/30* (2020.05)

(58) Field of Classification Search

CPC ..... B65D 47/00–0842; B65D 41/00–3423; B65D 2101/00–0046; B65D 43/14; B65D 2255/00; B65D 2401/00–60; B65D 83/00–759; B65D 50/06; E05B 17/00; E05B 3/00; E05B 9/00

See application file for complete search history.

(56) References Cited

U.S. PATENT DOCUMENTS

| | | | | |
|---|---|---|---|---|
| 4,401,227 A * | 8/1983 | Pehr | B65D 41/3447 215/252 |
| 4,795,044 A * | 1/1989 | Beck | B65D 47/0814 215/237 |
| 4,941,592 A | 7/1990 | Kitterman | |
| 4,974,735 A * | 12/1990 | Newell | B65D 41/58 215/253 |

(Continued)

FOREIGN PATENT DOCUMENTS

| | | |
|---|---|---|
| FR | 2842177 A1 | 1/2004 |
| GB | 2 430 667 A | 4/2007 |

(Continued)

*Primary Examiner* — Kareen K Thomas

(74) *Attorney, Agent, or Firm* — Nixon Peabody LLP

(57) ABSTRACT

A flip-top closure includes first and second closure polymeric portions. The first closure portion includes a top wall portion, a skirt portion and a tamper-evident feature being detachably connected to the annular skirt. The second closure portion includes a top wall portion, a skirt portion with an internal thread formation and an upwardly-extending locking tab, and a tamper-evident band. The first and second closure portions are attached via a hinge. The closure moves to an open position, resulting in the tamper-evident feature being detached from the remainder of the first closure portion and remaining adjacent to the skirt portion of the second closure portion in which the upwardly-extending locking tab assists in preventing or inhibiting the tamper-evident feature from falling off of the closure after the closure has been opened.

31 Claims, 9 Drawing Sheets

(56) References Cited

U.S. PATENT DOCUMENTS

| | | | | |
|---|---|---|---|---|
| 4,986,430 | A * | 1/1991 | Dutt | B65D 41/3428 215/216 |
| 5,219,084 | A | 6/1993 | King | |
| 5,979,681 | A | 11/1999 | Varlet | |
| 6,631,820 | B2 | 10/2003 | Harrold | |
| 7,044,317 | B2 | 5/2006 | Smith | |
| 7,821,638 | B2 | 10/2010 | Kim | |
| 8,490,804 | B2 | 7/2013 | Benoit-Gonin | |
| 8,708,175 | B2 | 4/2014 | Smith | |
| 9,764,879 | B2 | 9/2017 | Koenigseder | |
| 9,884,706 | B1 | 2/2018 | Skillin | |
| 10,266,311 | B2 * | 4/2019 | Rognard | B65D 47/0838 |
| 2002/0104843 | A1 * | 8/2002 | Smith | B65D 47/0842 220/270 |
| 2002/0130100 | A1 * | 9/2002 | Smith | B01L 3/50825 220/259.1 |
| 2003/0034323 | A1 | 2/2003 | Smith | |
| 2003/0057209 | A1 * | 3/2003 | Seelhofer | B65D 47/123 220/259.1 |
| 2004/0188374 | A1 | 9/2004 | Ochoa Laburu | |
| 2005/0023285 | A1 * | 2/2005 | Keung | B65D 47/0804 220/835 |
| 2010/0264145 | A1 | 10/2010 | Benoit-Gonin | |
| 2011/0284590 | A1 * | 11/2011 | Brannon | B65D 47/06 222/547 |
| 2012/0067922 | A1 | 3/2012 | Benoit-Gonin | |
| 2012/0211505 | A1 * | 8/2012 | Vollers | B65D 47/0838 220/833 |
| 2012/0241480 | A1 * | 9/2012 | Hindle | B65D 47/08 222/566 |
| 2013/0026188 | A1 * | 1/2013 | Lenz | B65D 47/065 222/153.14 |
| 2014/0008381 | A1 * | 1/2014 | Quinn | B65D 43/168 220/810 |
| 2014/0138380 | A1 | 5/2014 | Fox | |
| 2015/0175318 | A1 | 6/2015 | Pellerin | |
| 2015/0375908 | A1 * | 12/2015 | Rognard | B65D 47/0828 215/235 |
| 2016/0368674 | A1 * | 12/2016 | Ferrari | B65D 41/3433 |
| 2017/0297780 | A1 * | 10/2017 | Cesare | B65D 41/34 |
| 2018/0118423 | A1 | 5/2018 | Bois | |
| 2018/0170628 | A1 | 6/2018 | Rognard | |
| 2018/0229903 | A1 * | 8/2018 | Lee | B65D 47/0838 |
| 2018/0319551 | A1 * | 11/2018 | Ferrari | B65D 41/34 |
| 2019/0100361 | A1 * | 4/2019 | Stoneberg | B65D 43/162 |
| 2019/0119008 | A1 * | 4/2019 | Berroa Garcia | B65D 55/02 |

FOREIGN PATENT DOCUMENTS

| | | | |
|---|---|---|---|
| WO | WO 1997/037900 | A1 | 10/1997 |
| WO | WO 1998/057864 | A1 | 12/1998 |
| WO | WO 2002/028735 | A1 | 4/2002 |
| WO | WO 2002/053472 | A1 | 7/2002 |
| WO | WO 2009/056829 | A1 | 5/2009 |
| WO | WO 2010/112801 | A1 | 10/2010 |
| WO | WO 2012/131097 | A1 | 10/2012 |
| WO | WO 2015/049066 | A1 | 4/2015 |

* cited by examiner

FLIP-TOP CLOSURE

FIELD OF THE INVENTION

The present invention relates generally to a polymeric closure for a package. More specifically, the present invention relates to a hinged flip-top polymeric closure with tamper-evident features.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. This visual indication typically divides the closure into two separate components after the tamper-evident feature has been broken.

Tamper-evident features have been used in polymeric closures that are flip-top closures. These flip-top closures typically have an upper tamper-evident feature involving a lid and a lower tamper-evident feature on a bottom of a base. Potential drawbacks of these flip-top closures include the upper tamper-evident feature being separated from the remainder of the closure and/or having a higher likelihood of being tampered with. For example, the upper tamper-evident feature may be a "pull-away" or "break-away" feature that can be separated from the remainder of the closure and thrown away. These upper tamper-evident features are external features that have a greater likelihood of being tampered with.

If the upper tamper-evident feature is separated from the remainder of the closure and into two individual components, a portion of the flip-top closure is likely not recycled with the remainder of the closure and container. This scenario raises potential environment concerns with so many containers having tamper-evident features that can be separated into two or more individual components.

It would be desirable to provide a flip-top closure that has tamper-evident features that address these above-noted environmental concerns, while still performing all of the desirable properties of a closure.

SUMMARY

According to one embodiment, a flip-top closure includes a first closure portion and a second closure portion. The first closure portion includes a first polymeric top wall portion, a first polymeric annular skirt portion depending from the first polymeric top wall portion, and a polymeric tamper-evident feature being detachably connected to the first polymeric annular skirt portion by a first frangible connection. The second closure portion includes a second polymeric top wall portion forming an opening to gain access to the contents of a container, a second polymeric annular skirt portion and a polymeric tamper-evident band. The second polymeric annular skirt portion depends from the second polymeric top wall portion. The second polymeric annular skirt portion includes an internal thread formation for mating engagement with an external thread formation of the container. The second polymeric annular skirt portion includes an upwardly-extending locking tab. The polymeric tamper-evident band depends from and is at least partially detachably connected to the second polymeric annular skirt portion by a second frangible connection.

The first closure portion and the second closure portion are attached via a hinge. The hinge assists in moving the closure between an open position and a closed position. The closure is configured to move initially from the closed position to the open position via the hinge, resulting in the polymeric tamper-evident feature being detached from the remainder of the first closure portion and remaining adjacent to the second polymeric annular skirt portion in which the upwardly-extending locking tab assists in preventing or inhibiting the polymeric tamper-evident feature from falling off of the closure after the closure has been opened.

According to another embodiment, a package includes a container and a flip-top closure. The container has a neck portion defining an opening. The container has an external thread formation on the neck portion. The flip-top closure is configured for fitment to the neck portion of the container for closing the opening. The flip-top closure includes a first closure portion and a second closure portion. The first closure portion includes a first polymeric top wall portion, a first polymeric annular skirt portion depending from the first polymeric top wall portion, and a polymeric tamper-evident feature being detachably connected to the first polymeric annular skirt portion by a first frangible connection. The second closure portion includes a second polymeric top wall portion forming an opening to gain access to the contents of the container, a second polymeric annular skirt portion and a polymeric tamper-evident band. The second polymeric annular skirt portion depends from the second polymeric top wall portion. The second polymeric annular skirt portion includes an internal thread formation for mating engagement with an external thread formation of the container. The second polymeric annular skirt portion includes an upwardly-extending locking tab. The polymeric tamper-evident band depends from and is at least partially detachably connected to the second polymeric annular skirt portion by a second frangible connection.

The first closure portion and the second closure portion are attached via a hinge. The hinge assists in moving the closure between an open position and a closed position. During engagement with the container, the closure is configured to move initially from the closed position to the open position via the hinge, resulting in the polymeric tamper-evident feature being detached from the remainder of the first closure portion and remaining adjacent to the second polymeric annular skirt portion in which the upwardly-extending locking tab assists in preventing or inhibiting the polymeric tamper-evident feature from falling off of the closure after the closure has been opened.

According to another embodiment, a flip-top closure includes a first closure portion and a second closure portion. The first closure portion includes a first polymeric top wall portion, a first polymeric annular skirt portion depending from the first polymeric top wall portion, and a polymeric tamper-evident feature being detachably connected to the first polymeric annular skirt portion by a first frangible connection. The polymeric tamper-evident feature forms a plurality of apertures. The second closure portion includes a second polymeric top wall portion forming an opening to gain access to the contents of a container, a second polymeric annular skirt portion and a polymeric tamper-evident band. The second polymeric annular skirt portion depends from the second polymeric top wall portion. The second polymeric annular skirt portion includes an internal thread formation for mating engagement with an external thread formation of the container. The second polymeric annular skirt portion includes an upwardly-extending locking tab and a plurality of retaining tabs to assist in preventing or inhibiting the tamper-evident feature from separating from the closure after the closure has been moved to an open position. The polymeric tamper-evident band depends from and is at least partially detachably connected to the second polymeric annular skirt portion by a second frangible connection. The plurality of apertures is sized to correspond with a respective one of the plurality of retaining tabs.

The first closure portion and the second closure portion are attached via a hinge. The hinge assists in moving the closure between an open position and a closed position. The closure is configured to move initially from the closed position to the open position via the hinge, resulting in the polymeric tamper-evident feature being detached from the remainder of the first closure portion and remaining adjacent to the second polymeric annular skirt portion in which the upwardly-extending locking tab assists in preventing or inhibiting the polymeric tamper-evident feature from falling off of the closure after the closure has been opened.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
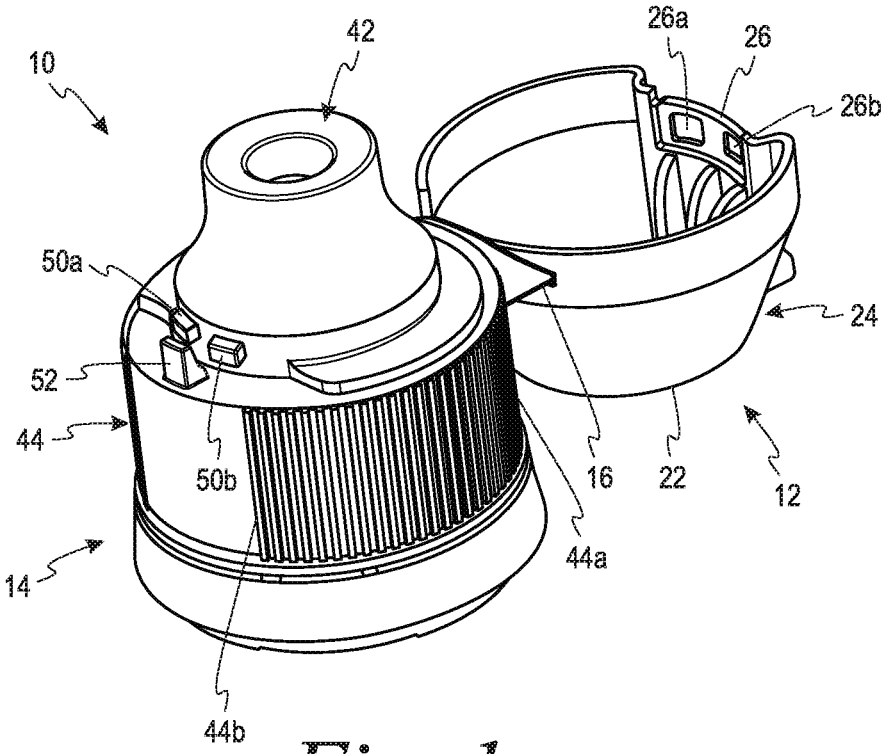
FIG. 1 is a top perspective view of a flip-top closure in an initial open position during the manufacturing process according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIGS. 1-5 illustrate a polymeric flip-top closure 10 according to one embodiment of the present invention. The closures are configured to be placed on a container or bottle that contain product. The product is typically a liquid product, but also may be a solid product or a combination of a liquid and solid product. The polymeric flip-top closure 10 of FIGS. 1-5 is generally cylindrically shaped. The flip-top closure is configured to assist in keeping it with the container so as to reduce environmental waste, while still providing desirable tamper-evident features. It is contemplated that the flip-top closure may be of other shapes and dimensions.

Referring still to FIGS. 1-5, the polymeric flip-top closure 10 includes a first closure portion or lid 12 and a second closure portion or base 14. The flip-top closure 10 is a one-piece closure. The first closure portion 12 and the second close portion 14 are connected via a hinge 16 that assists in moving the closure between an open position and a closed position. It is contemplated that the flip-top closure may be a two-piece closure.

Figure 2A:
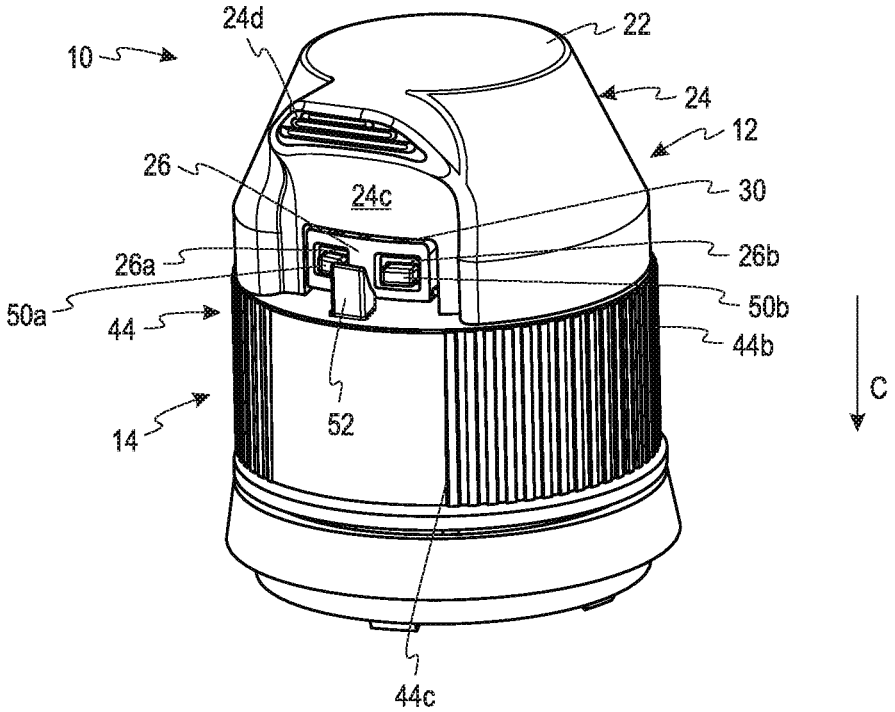
FIG. 2A is a top perspective view of the closure of FIG. 1 in a closed position.

The first closure portion 12 includes a polymeric top wall portion 22, a polymeric annular skirt portion 24 and a polymeric tamper-evident feature 26. As shown in FIG. 2A, the polymeric tamper-evident feature 26 is an upper tamper-evident feature. The polymeric annular skirt portion 24 depends from the top wall portion 22.

Figure 4A:
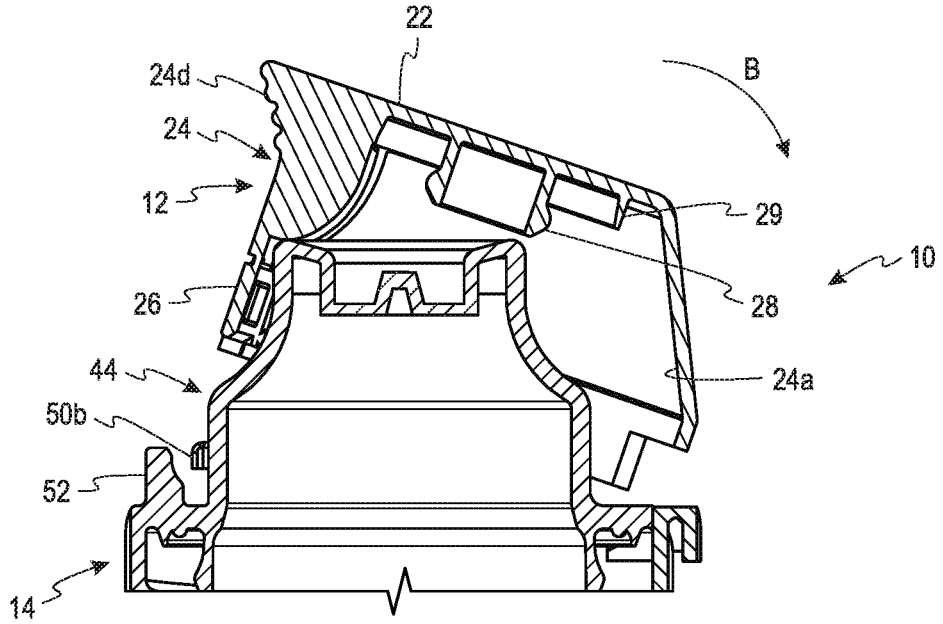
FIG. 4A is a generally cross-sectional side view of the closure of FIG. 1 beginning to be closed in a manufacturing step.
Figure 4B:
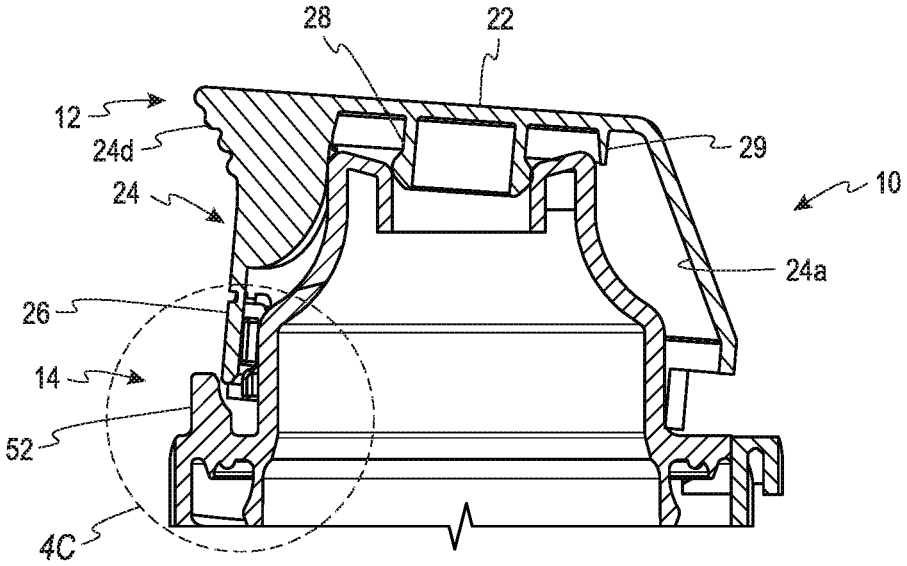
FIG. 4B is a generally cross-sectional side view of the closure of FIG. 4A moving closer to the closed position in a manufacturing step.

As shown in, for example, FIG. 4A, the first closure portion 12 includes a polymeric continuous plug seal 28 that depends from the polymeric top wall portion 22 and provides a sealing mechanism. The first closure portion also includes an outer seal 29 that depends from the polymeric top wall portion 22 and also provides a sealing mechanism. The continuous plug seal 28 and the outer seal 29 are spaced from an interior surface 24*a* of the polymeric annular skirt portion 24.

In another embodiment, the flip-top closure may include other sealing mechanisms. For example, the closure may include a polymeric lining material that provides a seal to the closure. This would be a two-piece closure. In this embodiment, the closure would be formed from separate components, but would function as the one-piece closure discussed except with a different sealing mechanism. In another embodiment, the closure may include either a polymeric outer seal or a continuous plug seal. It is contemplated that the flip-top closure may include other sealing mechanisms.

Figure 2B:
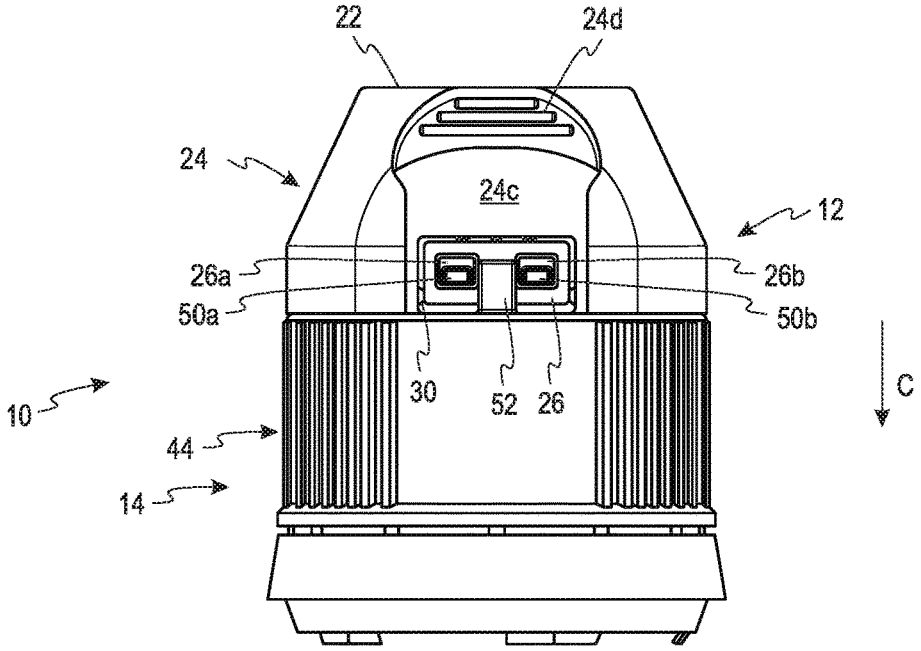
FIG. 2B is a front view of the closure of FIG. 2A.
Figure 2C:
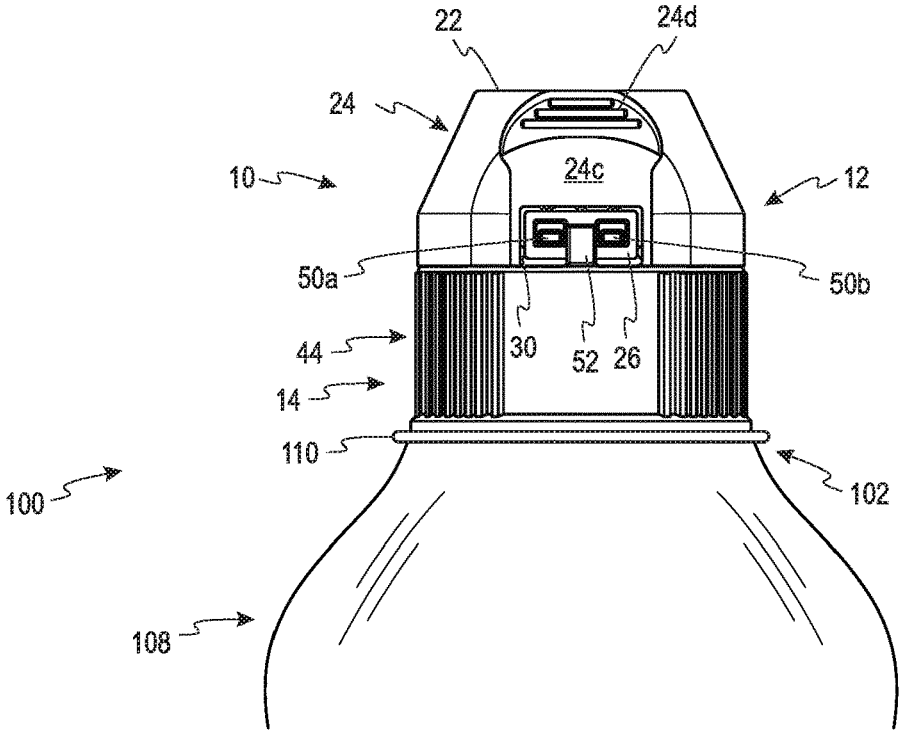
FIG. 2C is a front view of a package including the closure of FIG. 2A and a container according to one embodiment.

As shown in, for example, FIGS. 2A-2C, the polymeric tamper-evident feature 26 is detachably connected to the first polymeric annular skirt portion 24 by a first frangible connection 30. The polymeric tamper-evident feature 26 is initially detachably connected to the first closure portion 12. Once the closure moves from an initial closed position (see, e.g., FIGS. 2A, 2B) to an open position (see, e.g., FIGS. 3A, 3B), the polymeric tamper-evident feature 26 is detached from a remainder of the first closure portion 12. The polymeric tamper-evident feature 26 remains adjacent to a polymeric annular skirt portion 44 of the second closure portion 14.

The polymeric tamper-evident feature 26 of FIGS. 1, 2A-2C is shown as being generally rectangular shaped with a plurality of apertures 26*a*, 26*b* formed therein. It is contemplated that the polymeric tamper-evident feature may be of other shapes and sizes. For example, a polymeric tamper-evident feature may be other polygonal shapes (e.g., generally square) or a non-polygonal shape (e.g., generally circular or generally oval). It is also contemplated that a polymeric tamper-evident feature may include one aperture or a plurality of apertures. The at least one aperture may of other shapes and sizes.

Referring to FIGS. 2A-2C, an outer surface 24*c* of the polymeric annular skirt portion 24 may also include a plurality of ridges 24*d* thereon. The plurality of ridges 24*d* and shape of this contoured surface assists a user in gripping the closure 10 when flipping the first closure portion 12 with respect to the second closure portion 14.

Figure 3A:
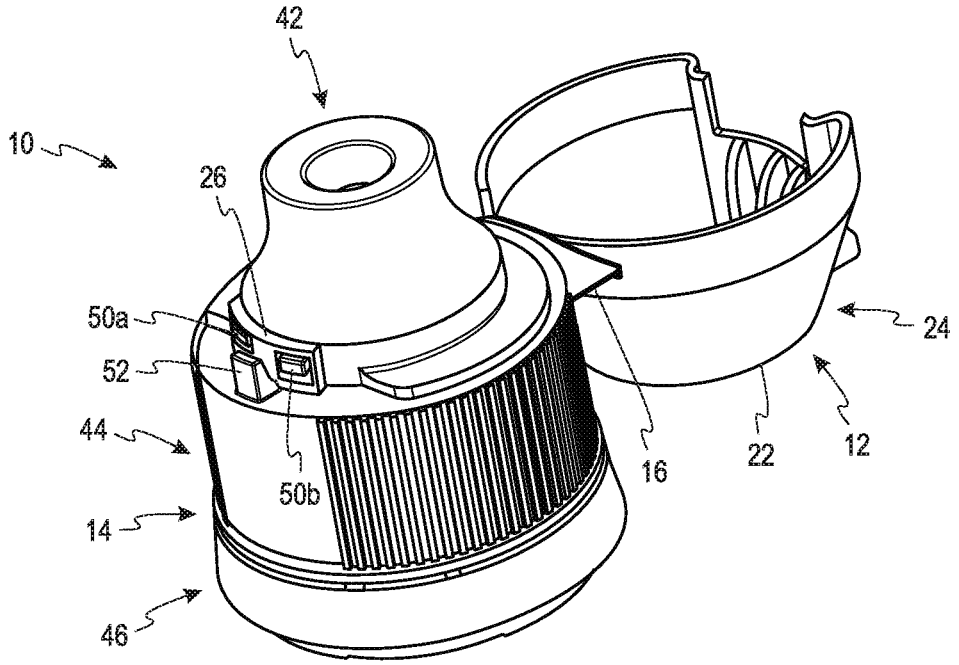
FIG. 3A is a top perspective view of the closure of FIG. 1 after being opened by a user.
Figure 3B:
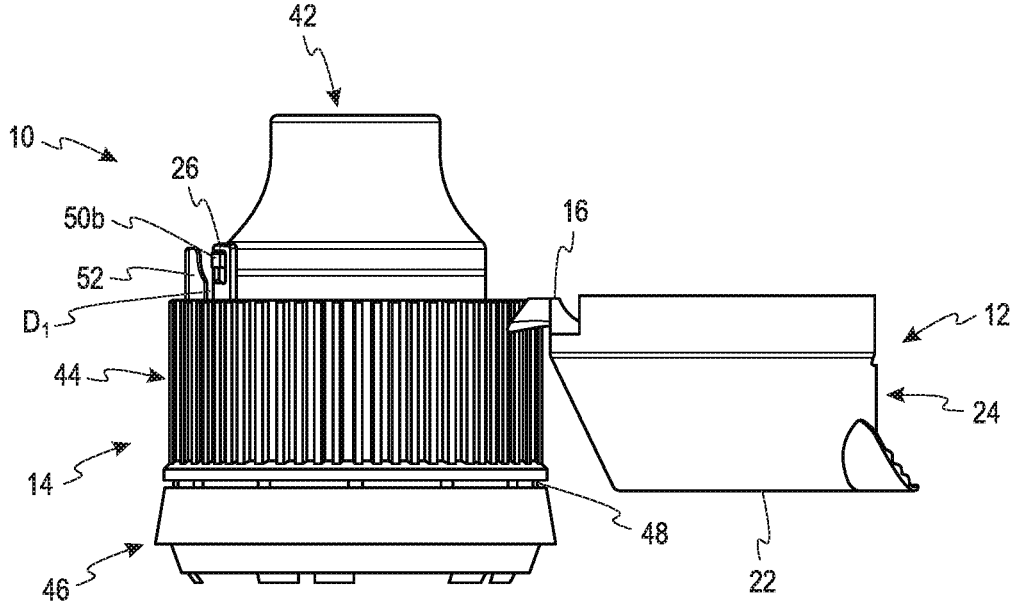
FIG. 3B is a side view of the closure of FIG. 3A.

Referring to FIGS. 3A, 3B, the second closure portion 14 includes a polymeric top wall portion 42, the polymeric annular skirt portion 44 and a polymeric tamper-evident band 46 depending from and being at least partially detachably connected to the polymeric annular skirt portion 44 by a second frangible connection 48. The polymeric annular skirt portion 44 depends from the polymeric top wall portion 42.

The polymeric annular skirt portion includes an internal thread formation for mating engagement with an external thread formation of a container. Specifically, the polymeric annular skirt portion 44 of FIGS. 5A-5D includes an internal thread formation 60 for mating engagement with an external thread formation of a container. The internal thread formation 60 includes a first closure lead 62 and a second closure lead 64. The first and second closure leads 62, 64 are referred collectively as a double lead closure thread. Each of the first and second closure leads 62, 64 is continuous. The first positions of the first and second closure leads 62, 64 may be located roughly 180 degrees apart from each other and, thus, begin on generally opposing sides of the closure 10.

It is contemplated that the first and second closure leads may be discontinuous. It is also contemplated that the internal thread formation of the closure may differ from a helical thread formation. It is also contemplated that other internal thread formations may be used in the closure. For example, the internal thread formation may include a triple-threaded structure having first, second and third closure leads.

The polymeric annular skirt portion of the second closure portion includes at least one retaining tab in one embodiment. The at least one retaining tab assists in preventing or inhibiting the tamper-evident feature from separating from the closure after the closure has been moved to an open position. In one embodiment, the at least one retaining tab may be an interference fit with the tamper-evident feature. An interference fit will assist in retaining the tamper-evident feature from separating from the closure after the closure has been moved to an open position.

For example, the polymeric annular skirt portion 44 of the flip-top closure 10 includes a plurality of retaining tabs 50*a*, 50*b*. The plurality of the retaining tabs 50*a*, 50*b* assists in preventing or inhibiting the tamper-evident feature 26 from falling off or separating from the closure 10 after the closure 10 has been moved to an open position (see, e.g., FIGS. 3A, 3B). Each of the plurality of retaining tabs 50*a*, 50*b* is shaped to generally correspond with a respective one of the apertures 26*a*, 26*b*. The plurality of retaining tabs 50*a*, 50*b* may form an interference fit with a respective one of the apertures 26*a*, 26*b*. The plurality of retaining tabs may be of different shapes and sizes than shown in FIGS. 3A, 3B.

The polymeric annular skirt portion 44 further includes an upwardly-extending locking tab 52. The upwardly-extending locking tab 52 is shown in FIGS. 1, 2A-2C as being generally vertical. It is contemplated that the locking tab may be slanted, although this may make the process of forming the closure more difficult. The locking tab 52 assists in containing the positioning of the polymeric tamper-evident feature 26 within the closure itself after the closure 10 has been opened. The locking tab 52 is located adjacent to the polymeric tamper-evident feature 26 and extends generally vertically to prevent or inhibit the polymeric tamper-evident feature 26 from falling off of the closure 10. The locking tab 52 is desirably located at a distance that is less than the thickness of the polymeric tamper-evident feature 26 to assist in preventing or inhibiting the tamper-evident feature 26 from being removed from or falling off of the closure 10 after the closure has been opened.

Figure 4C:
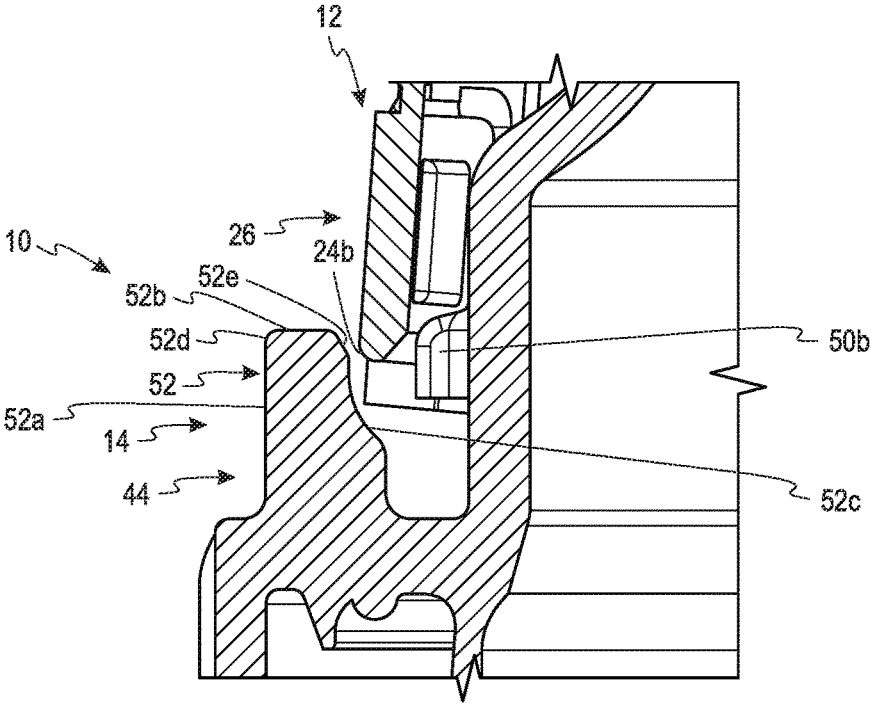
FIG. 4C is an enlarged cross-sectional side view of the general circle 4C of FIG. 4B.
Figure 4D:
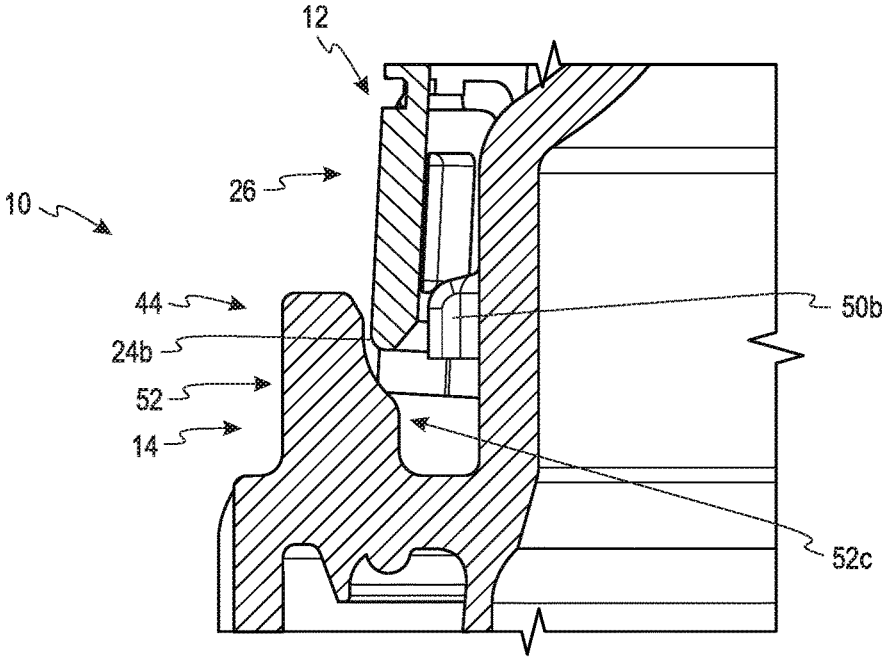
FIG. 4D is an enlarged partial cross-sectional side view of the closure of FIG. 4A when a tamper-evident feature is moving towards contacting a locking tab in a manufacturing step.
Figure 4E:
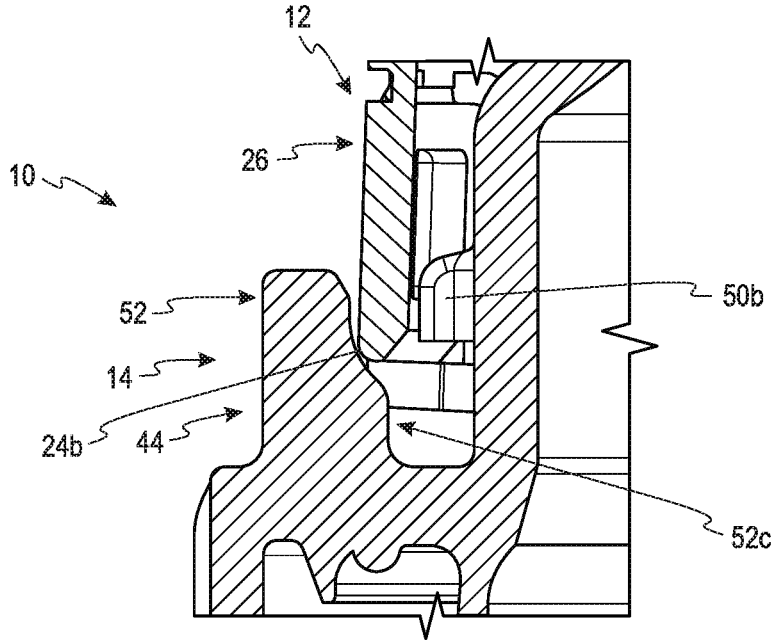
FIG. 4E is an enlarged partial cross-sectional side view of the closure of FIG. 4A showing the tamper-evident feature just before contacting the locking tab in a manufacturing step.

Referring to FIG. 4C, the shape of the locking tab 52 includes a generally vertical exterior surface 52*a*, a generally horizontal top surface 52*b* and a contoured interior surface 52*c*. The generally horizontal surface 52*b* encompasses the generally vertical surface 52*a* via a rounded portion 52*d*. A portion of the contoured interior surface 52*c* is concave and assists in contacting and guiding an end 24*b* of the annular skirt portion 24 during the initial closing process performed in manufacturing as will be discussed in more detail below. The contoured interior surface 52*c* also includes a chamfered portion 52*e* extending from the generally horizontal top portion 52*b*.

The contoured interior surface 52*c* assists in reducing an abrupt change in direction while applying and positioning the tamper-evident feature 26 during manufacturing. This reduces additional forces on the first frangible connection 30 that may cause the first frangible connection 30 to break prematurely during manufacturing. Thus, this shape of the interior surface 52*c* assists in reducing the stress on the first frangible connection 30 during the closing of the closure during manufacturing.

It is contemplated that the interior surface of the upwardly-extending locking tab may be of other shapes that would assist in guiding the end of the annular skirt portion during the initial closing process performed in the manufacturing.

In another embodiment, the interior surface of the upwardly-extending locking tab may include at least a portion being a chamfered surface. In this embodiment, it is desirable for the interior surface of the upwardly-extending locking tab to be substantially or entirely a chamfered surface. The chamfered surface is typically at an angle of about 40 to about 80 degrees and, more specifically, from about 50 to about 75 degrees. This is taken from a perspective where a vertical surface would be 90 degrees.

Referring back to FIG. 2A an outer surface 44*b* of the polymeric annular skirt portion 44 may also include a plurality of ridges 44*c* thereon. The plurality of ridges 44*c* assists a user in gripping when flipping the flip-top closure 10 between closed and open positions or when the first closure portion 12 is unthreaded or threaded with respect to the second closure portion 14.

The polymeric tamper-evident band 46 of the closure 10 is located at the bottom thereof (i.e., an end opposite of the polymeric top wall portion 22). The tamper-evident band 46 depends from and is at least partially detachably connected to the annular skirt portion 44 by the second frangible connection 48. As viewed in FIG. 1B, the polymeric tamper-evident band 46 is a lower tamper-evident feature. The tamper-evident band 46 works in conjunction with the container to indicate to a user that the contents of the container may have been accessed. More specifically, the tamper-evident band 46 is designed to at least partially separate from the annular skirt portion 44 if a user opens the package by unthreading and removing the closure to gain access to the container.

The first closure portion 12 and the second closure portion 14 are attached by the hinge 16. The hinge 16 assists in moving the closure 10 between an open position and a closed position. The hinge 16 is shown in FIGS. 3A, 3B in the open position and FIG. 5A in the closed position. The hinge 16 is adapted to flip at least about 120 degrees from a closed position (FIG. 5A) generally along arrow A of FIG. 5A until reaching an open position of FIG. 3A. It is most desirable for the hinge 16 to flip at least about 150 degrees or even more desirably at least 170 degrees from a closed position to an open position.

The first and second frangible connections 30, 48 may be formed by molded-in-bridges in one embodiment. The molded-in-bridges are typically formed using a feature in the mold. In another embodiment, the first and second frangible connections may be formed using scoring or scored lines, notches, leaders, nicks or other lines of weaknesses.

Figure 5A:
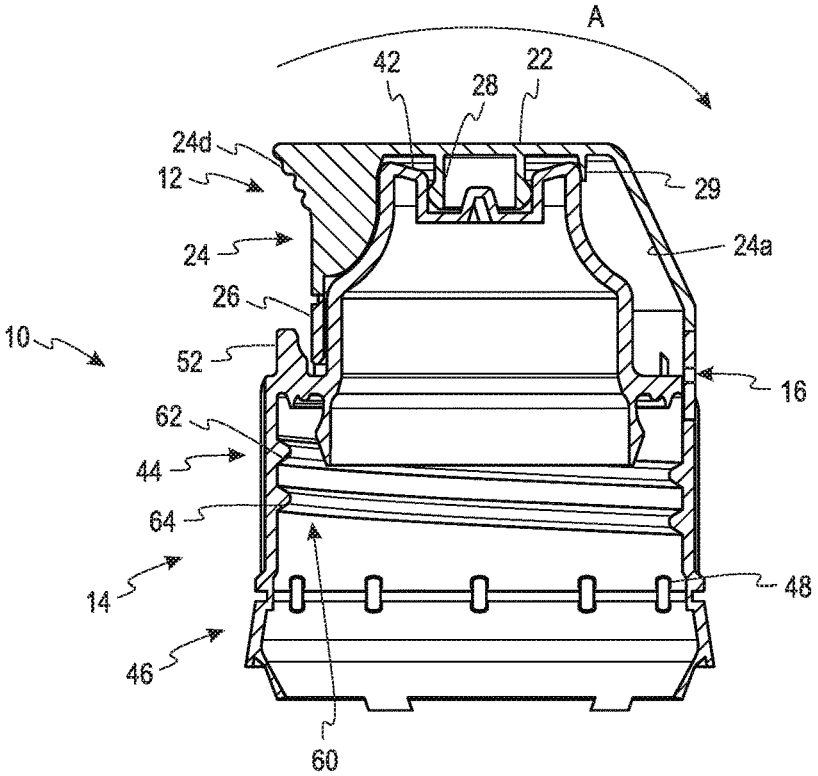
FIG. 5A is a cross-sectional side view of the closure of FIG. 4A showing the entire closure in the initial closed position after manufacturing.
Figure 5B:
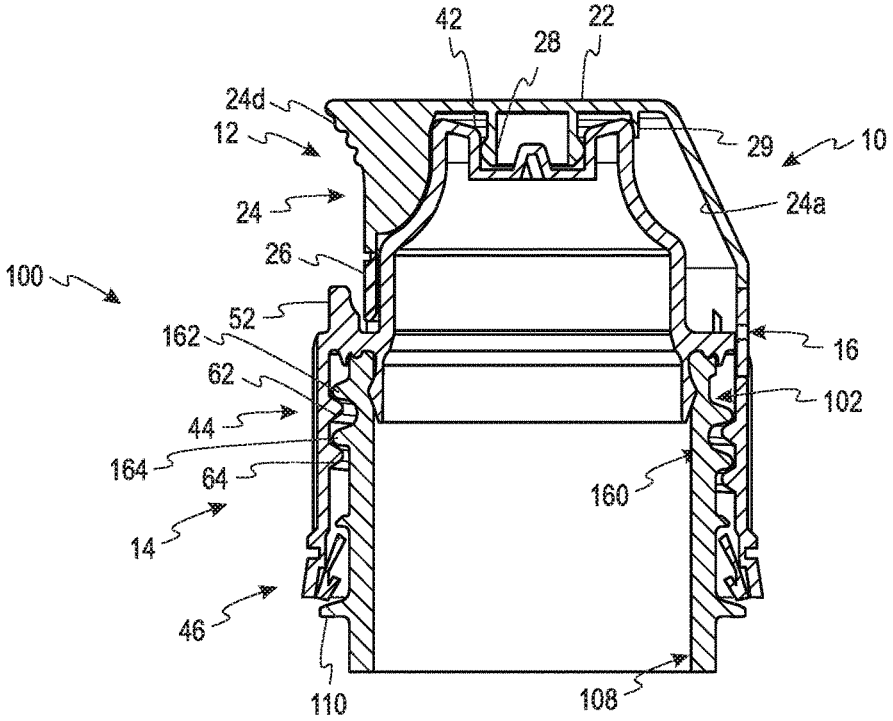
FIG. 5B is a cross-sectional view of a package including the closure of FIG. 5A and a container.
Figure 5C:
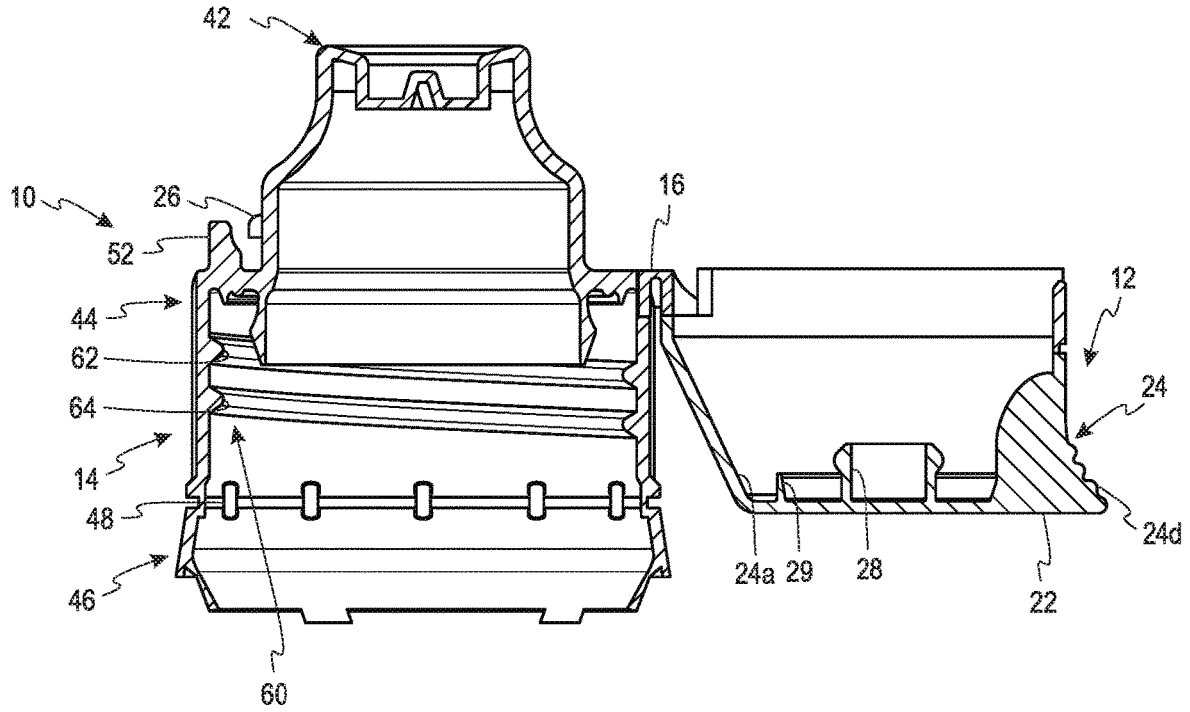
FIG. 5C is a cross-sectional side view of the closure of FIG. 5A showing the closure in an opened position before being closed during manufacturing.
Figure 5D:
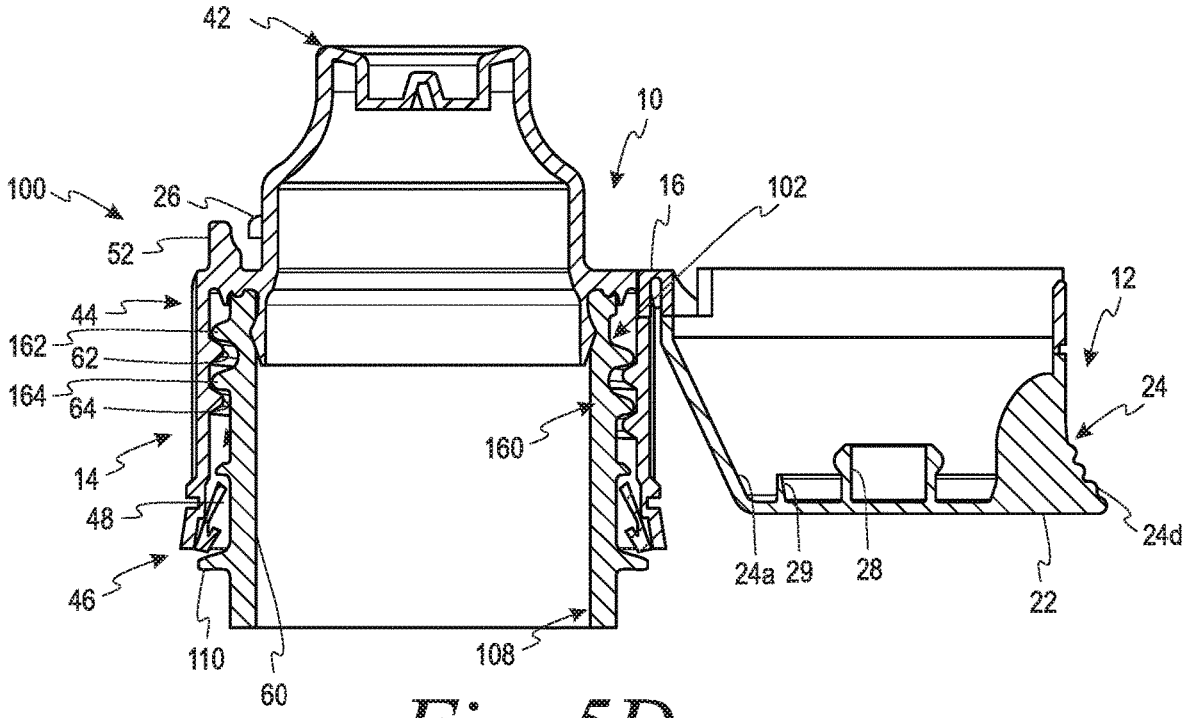
FIG. 5D is a cross-sectional side view of a package including the closure of FIG. 5C with a container.

One non-limiting example of a flip-top closure and a container forming a package is shown and discussed in conjunction with FIGS. 2C, 5B, 5D.

The closure of the present invention may be used with a container 108 used to form a package 100 of FIGS. 2C, 5B, 5D. Referring to FIGS. 5B, 5D, generally cross-sectional views of the package 100 are shown. Specifically, FIGS. 5B, 5D depict a portion of the container 108 that includes a neck portion 102 that defines an opening. The neck portion 102 of the container 108 includes an external thread formation 160 and a continuous outer ring 110 (FIG. 2C). The external thread formation 160 includes a first finish lead 162 and a second finish lead 164 (FIGS. 5B, 5D). The external thread formation 160 (finish leads 162, 164) engages with the corresponding internal thread formation 60 (closure leads 62, 64) to seal the package 100.

The first finish lead 162 begins near the open end of the container 108 and extends in a helical fashion to a second position that is closer to the closed end of the container. Similarly, the second finish lead 164 starts closer to the open end of the container 108 and extends in a helical fashion to a second position that is closer to the closed end of the container. Each of the first and second finish leads 162, 164 is continuous. The first positions of the first and second finish leads 162, 164 are located roughly 180 degrees apart from each other and, thus, begin on opposing sides of the neck portion 102 of the container 108. When opening the container 108, the first closure lead 62 is desirably in contact with the first finish lead 162 and the second closure lead 64 is desirably in contact with the second finish lead 164. It is contemplated that the external thread formation of the container may have discontinuous leads.

It is contemplated that the external thread formation of the container may be different than that disclosed with respect to container 108.

The continuous outer ring 110 assists in positioning the tamper-evident band 46 if the first closure portion 12 is unthreaded from the neck 102 of the container 108 by the breaking of the second frangible connection 48.

The closure of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closure may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2018/009979, U.S. Publication No. 2017/0349336, U.S. Pat. Nos. 9,126,726, 9,085,385, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties The top wall portion 22, the annular skirt portion 24, the tamper-evident feature 26, the top wall portion 42 and the annular skirt portion 44 are made of polymeric material. The top wall portion 22, the annular skirt portion 24, the tamper-evident feature 26, the top wall portion 42, and the annular skirt portion 44 are typically made of an olefin (e.g., polyethylene (PE), polypropylene (PP)), polyethylene terephthalate (PET) or blends thereof. One example of a polyethylene that may be used in high density polyethylene (HDPE). It is contemplated that the top wall portions, the annular skirt portions and tamper-evident feature may be made of other polymeric materials. The tamper-evident band 46 is typically made of the same materials as the top wall portion 22, the annular skirt portion 24, the tamper-evident feature 26, the top wall portion 42 and the annular skirt portion 44.

The closures are typically formed by processes such as injection or compression molding, extrusion or the combination thereof.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 108 typically has an encapsulated oxygen-barrier layer or oxygen barrier material incorporated therein.

Figure 4F:
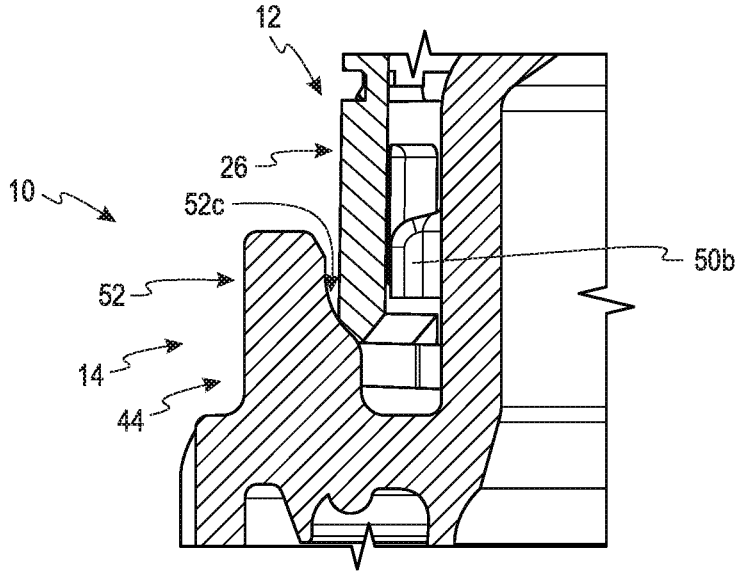
FIG. 4F is an enlarged partial cross-sectional side view of the closure of FIG. 4A showing the tamper-evident feature contacting the locking tab in a manufacturing step.
Figure 4G:
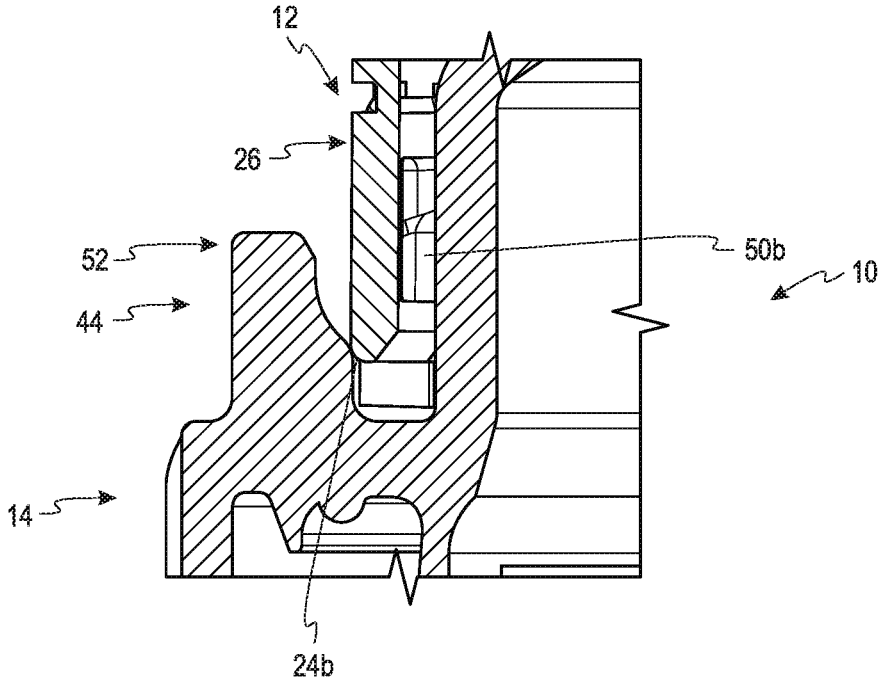
FIG. 4G is an enlarged partial cross-sectional side view of the closure of FIG. 4A showing the closure nearing the initial closed position in a manufacturing step.
Figure 4H:
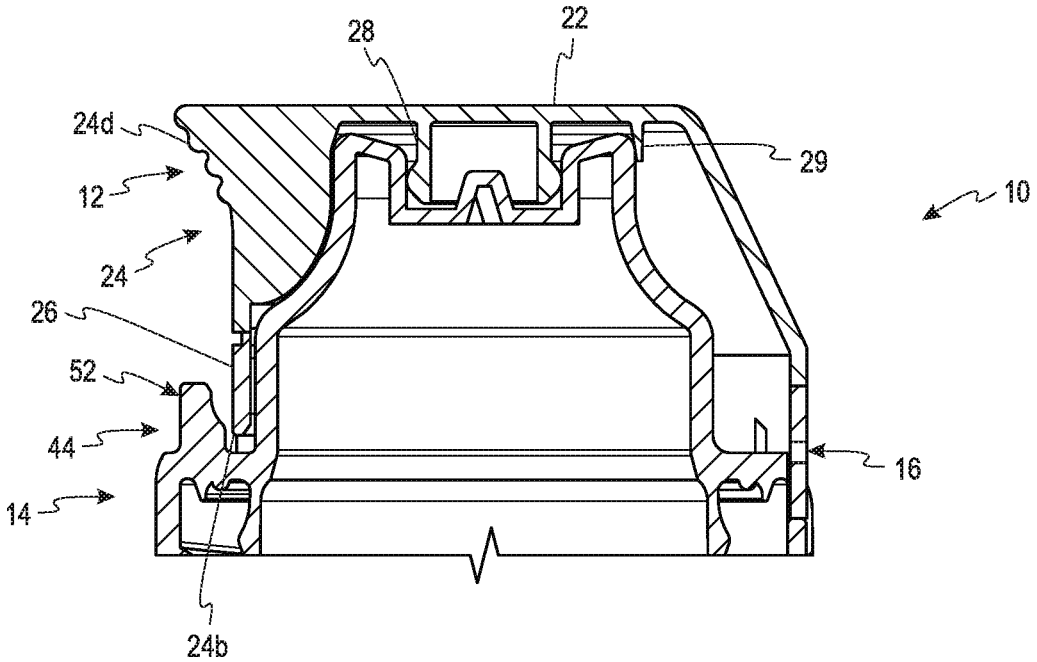
FIG. 4H is a cross-sectional side view of the closure of FIG. 4A showing the closure in the initial closed position after manufacturing.

The manufacturing process of closing the closure 10 is depicting in FIGS. 4A-H. This process is typically done before the closure is placed on a container to form a package. Specifically, FIG. 4A depicts the first closure portion 12 moving in a direction of arrow B. FIGS. 4B-4E depict the first tamper-evident feature 26 proceeding over one of the plurality of retaining tabs 50*b* during the initial process of closing the first closure portion 12 with respect to the second closure portion 14. FIG. 4F depicts the end 24*b* of the annular skirt portion 24 contacting the contoured interior surface 52*c* of the locking tab 52. As discussed above, the contoured interior surface 52*c* assists in contacting and guiding the end 24*b* of the annular skirt portion 24. The contoured interior surface 52*c* assists in making the manufacturing step smoother by reducing or inhibiting the likelihood of the first frangible connection 30 breaking apart before its intended use. FIG. 4G depicts the end 24*b* of the annular skirt portion 24 after clearing the locking tab 52. FIG. 4H depicts the closure 10 in the closed position after being closed during manufacturing.

In one method to open the container 108 and gain access to the product therein, the first closure portion 12 is initially flipped with respect to the second closure portion 14, which results in breaking and separating of the tamper-evident feature 26. Once the tamper-evident feature 26 is separated from the remainder of the polymeric top wall portion 22, the first closure portion 12 is flipped at least about 120 degrees and preferably at least about 150 or at least about 170 degrees with respect to the second closure portion 14. This is the typical way of gaining access to the product in the container 108.

When using this method, the tamper-evident feature 26 is separated via the first frangible connection 30 from the remainder of the first closure portion 12. The tamper-evident feature 26 will drop after the first frangible connection is broken (in the direction of arrow C in FIG. 2B). The breaking of the tamper-evident feature 26 from the remainder of the first closure portion 12 indicates that the first closure portion 12 has been opened with respect to the second closure portion 14. The different location of the tamper-evident feature 26 after breaking of the first frangible connection also assists a user in determining that package may have been opened. The initial positioning of the tamper-evident feature 26 is shown in FIGS. 2A, 2B, while the positioning of the tamper-evident feature after opening is shown in FIGS. 3A, 3B. The tamper-evident feature 26 in FIGS. 2A, 2B is held by the frangible connection 30 and is shown contacting a lower surface of the retaining tabs 50*a*, 50*b* in a closed position. FIGS. 3A, 3B show the tamper-evident feature 26 contacting an upper surface of the retaining tabs 50*a*, 50*b* after being opened. Thus, the positioning of the tamper-evident feature 26 is lower (in the direction of arrow C of FIGS. 2A, 2B) after being opened.

The locking tab 52 assists in containing the positioning of the polymeric tamper-evident feature 26 after the closure 10 has been opened. As discussed above, the locking tab 52 is located adjacent to the polymeric tamper-evident feature 26 and prevents or inhibits the polymeric tamper-evident feature 26 from falling off of the closure 10. The locking tab 52 is desirably located at a distance D1 (See FIG. 3B) that is less than the thickness of the polymeric tamper-evident feature 26 so as to assist in preventing or inhibiting the tamper-evident feature 26 from being removed from or falling off of the closure 10 after the closure has been opened.

In another method to open the container 108 and gain access to the product therein, the closure 10 may be unthreaded by turning the closure 10 with respect to the container 108. After the closure has been unthreaded, the closure 10 can be removed from the container 108. When using this method, the tamper-evident band 46 is at least partially separated from the reminder of the closure 10 via the second frangible connection 48, which indicates that the closure 10 has been unthreaded with respect to the container 108.

The polymeric closure of the present invention is desirable in both low-temperature and high-temperature applications. The polymeric closure may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures formed by the processes of the present invention.

The polymeric closure of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closure of the present invention can be used in other high-temperature applications.

What is claimed is:

1. A flip-top closure comprising:

a first closure portion, wherein the first closure portion includes:

a first polymeric top wall portion, a first polymeric annular skirt portion depending from the first polymeric top wall portion, and a polymeric tamper-evident feature being detachably connected to the first polymeric annular skirt portion by a first frangible connection; and a second closure portion, wherein the second closure portion includes:

a second polymeric top wall portion forming an opening to gain access to contents of a container, a second polymeric annular skirt portion depending from the second polymeric top wall portion, the second polymeric annular skirt portion including an internal thread formation for mating engagement with an external thread formation of the container, the second polymeric annular skirt portion including an upwardly-extending locking tab and at least one outwardly-extending retaining tab to assist in preventing or inhibiting the polymeric tamper-evident feature from separating from the closure after the closure has been moved to an open position, a polymeric tamper-evident band depending from and being at least partially detachably connected to the second polymeric annular skirt portion by a second frangible connection, wherein the first closure portion and the second closure portion are attached via a hinge, the hinge assisting in moving the closure between an open position and a closed position, wherein the closure is configured to move initially from the closed position to the open position via the hinge, resulting in the polymeric tamper-evident feature being detached from a remainder of the first closure portion and remaining adjacent to the second polymeric annular skirt portion in which the upwardly-extending locking tab assists in preventing or inhibiting the polymeric tamper-evident feature from falling off of the closure after the closure has been opened.

2. The closure of claim 1, wherein the polymeric tamper-evident feature forms at least one aperture, the at least one aperture being sized to correspond with the at least one outwardly-extending retaining tab.

3. The closure of claim 2, wherein the at least one outwardly-extending retaining tab forms an interference fit with the at least one aperture.

4. The closure of claim 1, wherein the at least one outwardly-extending retaining tab is a plurality of retaining tabs.

5. The closure of claim 4, wherein the polymeric tamper-evident feature forms a plurality of apertures, each of the plurality of apertures corresponding with a respective one of the plurality of outwardly-extending retaining tabs.

6. The closure of claim 1, wherein the tamper-evident feature is generally rectangular.

7. The closure of claim 1, wherein the upwardly-extending locking tab is generally vertical.

8. The closure of claim 1, wherein at least a portion of an interior shape of the upwardly-extending locking tab is contoured to assist in initially positioning the first closure portion with respect to the second closure portion prior to opening.

9. The closure of claim 8, wherein at least a portion of the interior shape of the upwardly-extending locking tab is concave.

10. The closure of claim 1, wherein the first closure portion further includes a polymeric continuous plug seal depending from the first polymeric top wall portion.

11. The closure of claim 1, wherein the first closure portion further includes a sealing mechanism to assist in sealing the closure with the container.

12. The closure of claim 1, wherein the shape of the closure is generally cylindrical and is a one-piece closure.

13. The closure of claim 1, wherein the closure comprises polyolefins.

14. A package comprising:

a container having a neck portion defining an opening, the container having an external thread formation on the neck portion; and a flip-top closure being configured for fitment to the neck portion of the container for closing the opening, the flip-top closure including a first closure portion and a second closure portion, the first closure portion including:

a first polymeric top wall portion, a first polymeric annular skirt portion depending from the first polymeric top wall portion, and a polymeric tamper-evident feature being detachably connected to the first polymeric annular skirt portion by a first frangible connection; and the second closure portion including:

a second polymeric top wall portion forming an opening to gain access to contents of the container, a second polymeric annular skirt portion depending from the second polymeric top wall portion, the second polymeric annular skirt portion including an internal thread formation for mating engagement with an external thread formation of the container, the second polymeric annular skirt portion including an upwardly-extending locking tab and at least one outwardly-extending retaining tab to assist in preventing or inhibiting the polymeric tamper-evident feature from separating from the closure after the closure has been moved to an open position, a polymeric tamper-evident band depending from and being at least partially detachably connected to the second polymeric annular skirt portion by a second frangible connection, wherein the first closure portion and the second closure portion are attached via a hinge, the hinge assisting in moving the closure between an open position and a closed position, wherein during engagement with the container, the closure is configured to move initially from the closed position to the open position via the hinge, resulting in the polymeric tamper-evident feature being detached from a remainder of the first closure portion and remaining adjacent to the second polymeric annular skirt portion in which the upwardly-extending locking tab assists in preventing or inhibiting the polymeric tamper-evident feature from falling off of the closure after the closure has been opened.

15. The package of claim 14, wherein the polymeric tamper-evident feature forms at least one aperture, the at least one aperture being sized to correspond with the at least one outwardly-extending retaining tab.

16. The package of claim 14, wherein the at least one outwardly-extending retaining tab is a plurality of retaining tabs.

17. The package of claim 14, wherein at least a portion of an interior shape of the upwardly-extending locking tab is contoured to assist in initially positioning the first closure portion with respect to the second closure portion prior to opening.

18. The package of claim 17, wherein at least a portion of the interior shape of the upwardly-extending locking tab is concave.

19. A flip-top closure comprising:

a first closure portion, wherein the first closure portion includes:

a first polymeric top wall portion, a first polymeric annular skirt portion depending from the first polymeric top wall portion, and a polymeric tamper-evident feature being detachably connected to the first polymeric annular skirt portion by a first frangible connection, the polymeric tamper-evident feature forming a plurality of apertures; and a second closure portion, wherein the second closure portion includes:

a second polymeric top wall portion forming an opening to gain access to contents of a container, a second polymeric annular skirt portion depending from the second polymeric top wall portion, the second polymeric annular skirt portion including an internal thread formation for mating engagement with an external thread formation of the container, the second polymeric annular skirt portion including an upwardly-extending locking tab and a plurality of retaining tabs to assist in preventing or inhibiting the tamper-evident feature from separating from the closure after the closure has been moved to an open position, and a polymeric tamper-evident band depending from and being at least partially detachably connected to the second polymeric annular skirt portion by a second frangible connection, wherein the plurality of apertures is sized to correspond with a respective one of the plurality of retaining tabs, wherein the first closure portion and the second closure portion are attached via a hinge, the hinge assisting in moving the closure between an open position and a closed position, wherein the closure is configured to move initially from the closed position to the open position via the hinge, resulting in the polymeric tamper-evident feature being detached from a remainder of the first closure portion and remaining adjacent to the second polymeric annular skirt portion in which the upwardly-extending locking tab assists in preventing or inhibiting the polymeric tamper-evident feature from falling off of the closure after the closure has been opened.

20. The closure of claim 19, wherein at least a portion of an interior shape of the upwardly-extending locking tab is contoured to assist in initially positioning the first closure portion with respect to the second closure portion prior to opening.

21. The closure of claim 20, wherein at least a portion of the interior shape of the upwardly-extending locking tab is concave.

22. The closure of claim 19, wherein the plurality of retaining tabs is outwardly-extending from the second polymeric annular skirt portion.

23. The closure of claim 19, wherein the tamper-evident feature is generally rectangular.

24. The closure of claim 19, wherein the upwardly-extending locking tab is generally vertical.

25. The closure of claim 19, wherein the first closure portion further includes a polymeric continuous plug seal depending from the first polymeric top wall portion.

26. The closure of claim 19, wherein the shape of the closure is generally cylindrical and is a one-piece closure.

27. A package comprising:

a container having a neck portion defining an opening, the container having an external thread formation on the neck portion; and a flip-top closure being configured for fitment to the neck portion of the container for closing the opening, the flip-top closure including a first closure portion and a second closure portion, the first closure portion including:

a first polymeric top wall portion, a first polymeric annular skirt portion depending from the first polymeric top wall portion, and a polymeric tamper-evident feature being detachably connected to the first polymeric annular skirt portion by a first frangible connection, the polymeric tamper-evident feature forming a plurality of apertures; and the second closure portion including:

a second polymeric top wall portion forming an opening to gain access to contents of a container, a second polymeric annular skirt portion depending from the second polymeric top wall portion, the second polymeric annular skirt portion including an internal thread formation for mating engagement with an external thread formation of the container, the second polymeric annular skirt portion including an upwardly-extending locking tab and a plurality of retaining tabs to assist in preventing or inhibiting the tamper-evident feature from separating from the closure after the closure has been moved to an open position, and a polymeric tamper-evident band depending from and being at least partially detachably connected to the second polymeric annular skirt portion by a second frangible connection, wherein the plurality of apertures is sized to correspond with a respective one of the plurality of retaining tabs, wherein the first closure portion and the second closure portion are attached via a hinge, the hinge assisting in moving the closure between an open position and a closed position, wherein the closure is configured to move initially from the closed position to the open position via the hinge, resulting in the polymeric tamper-evident feature being detached from a remainder of the first closure portion and remaining adjacent to the second polymeric annular skirt portion in which the upwardly-extending locking tab assists in preventing or inhibiting the polymeric tamper-evident feature from falling off of the closure after the closure has been opened.

28. The package of claim 27, wherein at least a portion of an interior shape of the upwardly-extending locking tab is contoured to assist in initially positioning the first closure portion with respect to the second closure portion prior to opening.

29. The package of claim 27, wherein at least a portion of the interior shape of the upwardly-extending locking tab is concave.

30. The package of claim 27, wherein the plurality of retaining tabs is outwardly-extending from the second polymeric annular skirt portion.

31. The package of claim 27, wherein the upwardly-extending locking tab is generally vertical.

* * * * *